US009759173B2

(12) United States Patent
Hashida et al.

(10) Patent No.: US 9,759,173 B2
(45) Date of Patent: Sep. 12, 2017

(54) HIGH-PRESSURE FUEL PUMP

(71) Applicant: Hitachi Automotive Systems, Ltd., Hitachinaka-shi, Ibaraki (JP)

(72) Inventors: Minoru Hashida, Hitachinaka (JP); Hiroyuki Yamada, Hitachinaka (JP); Masayuki Suganami, Iwaki (JP); Sunao Takahashi, Tokyo (JP); Toru Onose, Ibaraki (JP); Hideaki Yamauchi, Hitachinaka (JP); Kazuichi Ishige, Mito (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 6 days.

(21) Appl. No.: 14/704,057

(22) Filed: May 5, 2015

(65) Prior Publication Data

US 2015/0233332 A1 Aug. 20, 2015

Related U.S. Application Data

(62) Division of application No. 13/500,384, filed as application No. PCT/JP2010/063853 on Aug. 17, 2010, now abandoned.

(30) Foreign Application Priority Data

Oct. 6, 2009 (JP) ..... 2009-232092

(51) Int. Cl.
*F02M 59/10* (2006.01)
*F02M 59/02* (2006.01)
*F02M 59/44* (2006.01)

(52) U.S. Cl.
CPC ..... *F02M 59/102* (2013.01); *F02M 59/025* (2013.01); *F02M 59/442* (2013.01)

(58) Field of Classification Search
CPC ..... F02M 59/102; F02M 39/02; F02M 59/28; F02M 55/005; F02M 59/44; F02M 59/462; F02M 2200/02
(Continued)

(56) References Cited

U.S. PATENT DOCUMENTS 4,356,977 A 11/1982 Hofmann
5,752,430 A * 5/1998 Kawajiri ..... F04B 1/0439 417/471
(Continued)

FOREIGN PATENT DOCUMENTS

DE 10 2004 063 074 A1 7/2006
JP 39-2504 B1 3/1939
(Continued)

OTHER PUBLICATIONS (Form PCT/IPEA/409) English Translation of International Preliminary Report on Patentability dated Jan. 20, 2012 (three (3) pages).
(Continued)

*Primary Examiner* — Sizo Vilakazi
(74) *Attorney, Agent, or Firm* — Crowell & Moring LLP

(57) ABSTRACT

A high-pressure fuel pump includes a pump body, a plunger, a retainer, a spring that is configured to energize the plunger in a direction opposite to a direction of the pressurizing chamber, and a tappet covering the retainer from a side of an end portion of the retainer and the plunger. The retainer is provided with a projection portion protruding to a side of the tappet. The projection portion is separated from the tappet by a predetermined distance along an axial direction of the plunger.

14 Claims, 13 Drawing Sheets

(58) Field of Classification Search
USPC ..... 123/507, 508, 509
See application file for complete search history.

(56) References Cited

U.S. PATENT DOCUMENTS

| | | | | |
|---|---|---|---|---|
| 2003/0161746 | A1* | 8/2003 | Asayama | F02M 39/00 417/470 |
| 2003/0175137 | A1* | 9/2003 | Inoue | F04B 1/0439 417/470 |
| 2009/0097997 | A1* | 4/2009 | Suzuki | F02M 59/462 417/470 |
| 2009/0288639 | A1* | 11/2009 | Usui | F02M 55/04 123/457 |
| 2011/0253109 | A1* | 10/2011 | Usui | F02M 39/02 123/509 |

FOREIGN PATENT DOCUMENTS

| | | | |
|---|---|---|---|
| JP | 42-10126 | B1 | 5/1942 |
| JP | 56-132455 | A | 10/1981 |
| JP | 62-284954 | A | 12/1987 |
| JP | 10-110659 | A | 4/1998 |
| JP | 2001-295770 | A | 10/2001 |
| JP | 2006-118380 | A | 5/2006 |
| JP | 2010-127153 | A | 6/2010 |
| WO | WO 2006/069819 | A1 | 7/2006 |

OTHER PUBLICATIONS

International Search Report with English translation dated Nov. 22, 2010 (four (4) pages).

* cited by examiner

DESCENDING STROKE

ASCENDING STROKE

HIGH-PRESSURE FUEL PUMP

This application is a divisional of U.S. application Ser. No. 13/500,384, filed on Apr. 5, 2012, which is a National Stage application of PCT International Application PCT/JP2010/063853, filed Aug. 17, 2010, which claims priority from Japanese Patent Application No. 2009-232092, filed on Oct. 6, 2009, the disclosures of all of which are expressly incorporated by reference herein.

TECHNICAL FIELD

The present invention relates to a fuel supply pump of an automotive internal combustion engine, and more particularly to a high-pressure fuel pump which supplies a high-pressure fuel to a fuel injection valve of a cylinder injection type internal combustion engine.

BACKGROUND ART

The high-pressure fuel pump at which the present invention aims is provided with a plunger which is slidably fitted to a cylinder, and one end of the plunger reciprocates within a pressurizing chamber, thereby compressing and pressurizing a fuel introduced to the pressurizing chamber from an intake valve mechanism so as to discharge from a discharge valve mechanism. The plunger is achieved by converting a rotating motion of a cam which is formed in a cam shaft of the engine into an upward and downward reciprocating motion of the plunger. An annular retainer in which a lower end of the plunger is fixed to a center portion is stored within a tappet on a cup, and a roller is attached to a surface of the tappet in an opposite side to the retainer, and the roller is brought into pressure contact with the cam, and moves up and down along the surface of the cam in accordance with the rotation of the cam, thereby moving up and down the plunger. A helical spring is installed between the retainer and the pump housing (or the cylinder) in such a manner as to surround the plunger, and the spring is compressed on the basis of the rotation of the cam at a time of an ascending step of the plunger. In a descending step of the plunger, the plunger moves down along the cam surface on the basis of a compression reaction force of the spring. (the roller is not necessarily required.)

In this case, this kind of high-pressure pump has a narrow portion in which a diameter becomes smaller than a diameter of a sliding portion of the plunger with the cylinder, in a portion (a portion surrounded by the spring) of a lower end portion of the plunger, and a step portion (a neck portion) is formed in a diameter switch portion.

The lower end portion of the plunger is pressure inserted and fixed to a retainer having a through hole in the center in accordance with a close fit (International Laid-Open Pamphlet WO2006/069819).

An end portion in a side of the retainer of the plunger protrudes slightly out of the lower end surface of the retainer, a protruding portion comes into contact with a surface of the tappet, and an annular surface in a side of the tappet of the annular retainer faces to a surface in a side of the retainer of the tappet while keeping a necessary gap. The necessary gap is a distance which is larger than a swing range of the tappet at a time when the tappet swings on the basis of the rotation of the cam.

SUMMARY OF THE INVENTION

Problem to be Solved by the Invention

In the prior art mentioned above, the close fit portion of the plunger and the retainer slacks with age due to an environmental factor, and there is such a problem that a necessary fixing force can not be maintained.

As a result, if the fixing force between the plunger and the retainer is lowered, or a contact surface between the plunger and the retainer is worn away, the annular surface in the side of the tappet of the retainer comes closer to the plunger contact surface (the surface in the side of the retainer) of the tappet than an original installed position thereof on the basis of an actuating force of the spring, and a clearance (a gap) between the retainer and the tappet becomes smaller than necessary (they comes into contact with each other at worst).

If the clearance between the retainer and the tappet becomes smaller than necessary, a force which reclines the retainer is generated on the basis of a slight incline of the tappet or the pump itself, so that a side force is applied to the plunger. The side force generates a bending moment in the plunger. The bending moment increases a contact surface pressure between the plunger and the cylinder so as to come to a cause of a sticking between the plunger and the cylinder.

In the structure in which the narrow portion having the smaller diameter than the diameter of the sliding portion with the cylinder of the plunger is provided in the portion (the portion surrounded by the spring) of the lower end portion of the plunger, and the step portion (the neck portion) is formed in the diameter switch portion, there can be thought that the plunger is broken in this step portion.

Taking the above points into consideration, an object of the present invention is to provide a high-pressure fuel pump in which a clearance (a gap) between a plunger and a retainer is hard to be changed with age.

Means for Solving the Problem

In order to achieve the object mentioned above, the present invention is structured such that a protruding portion protruding to a tappet side is provided in a center portion of a retainer.

In other words, in accordance with the present invention, there is provided a high-pressure fuel pump comprising:

a pump body which has a cylinder portion;

a plunger which is slidably fitted to the cylinder portion;

a pressurizing chamber which is provided in one side of the plunger, and in which a volumetric capacity is changed by a reciprocating motion of the plunger;

a retainer portion which is fixed to an end portion of the plunger protruding out of the cylinder to an opposite side to the pressurizing chamber;

a spring which is arranged around the plunger in such a manner as to surround the plunger, is retained at one end to the retainer, and energizes the plunger in such a direction as to back away from the pressurizing chamber; and a motion of a rotating cam being converted into a reciprocating motion of the plunger via a tappet, wherein a projection portion protruding out to the tappet side is provided around a through hole for inserting the plunger provided in a center of the retainer.

Further, in the high-pressure pump mentioned above, it is preferable that it is structured such that a clearance between the retainer and the tappet in the projection portion is smaller than the other clearances formed between the retainer and the tappet.

Further, in the high-pressure pump mentioned above, it is preferable that the projection portion of the retainer is constructed by an annular projection on the same axis as the center axis of the plunger which is fixed to the retainer.

Further, in the high-pressure pump mentioned above, it is preferable that the projection portion of the retainer has a spherical surface in a leading end portion.

Further, in the high-pressure pump mentioned above, it is preferable that a surface hardness of the projection portion of the retainer is smaller than a surface hardness of the plunger.

Further, in the high-pressure pump mentioned above, it is preferable that the retainer and the projection portion are integrally formed by a press molding from a sheet member.

Further, in the high-pressure pump mentioned above, it is preferable that a chamfer is applied to an outer peripheral portion in a surface which is opposed to the tappet of the retainer.

Further, in the high-pressure pump mentioned above, it is preferable that it is structured such that a leading end portion of the projection portion and a leading end surface of the plunger are positioned on the same plane.

Further, in the high-pressure pump mentioned above, it is preferable that the end surface of the plunger protrudes out of the leading end portion of the projection portion to the tappet side.

Effect of the Invention

In accordance with the high-pressure fuel pump of the present invention which is structured as mentioned above, since it is possible to maintain the clearance between the retainer and the tappet even if the connection between the retainer and the plunger slacks, it is possible to make a sticking between the plunger and the cylinder and a breakage accident of the plunger hard to be generated, even if the side force acts on the retainer.

Other objects, features and advantages of the invention will become apparent from the following description of the embodiments of the invention taken in conjunction with the accompanying drawings.

MODE FOR CARRYING OUT THE INVENTION

A description will be in detail given below of several embodiments in accordance with the present invention with reference to the accompanying drawings.

Embodiment 1

A description will be given of a first embodiment in accordance with the present invention with reference to FIGS. 1 to 14.

Figure 1:
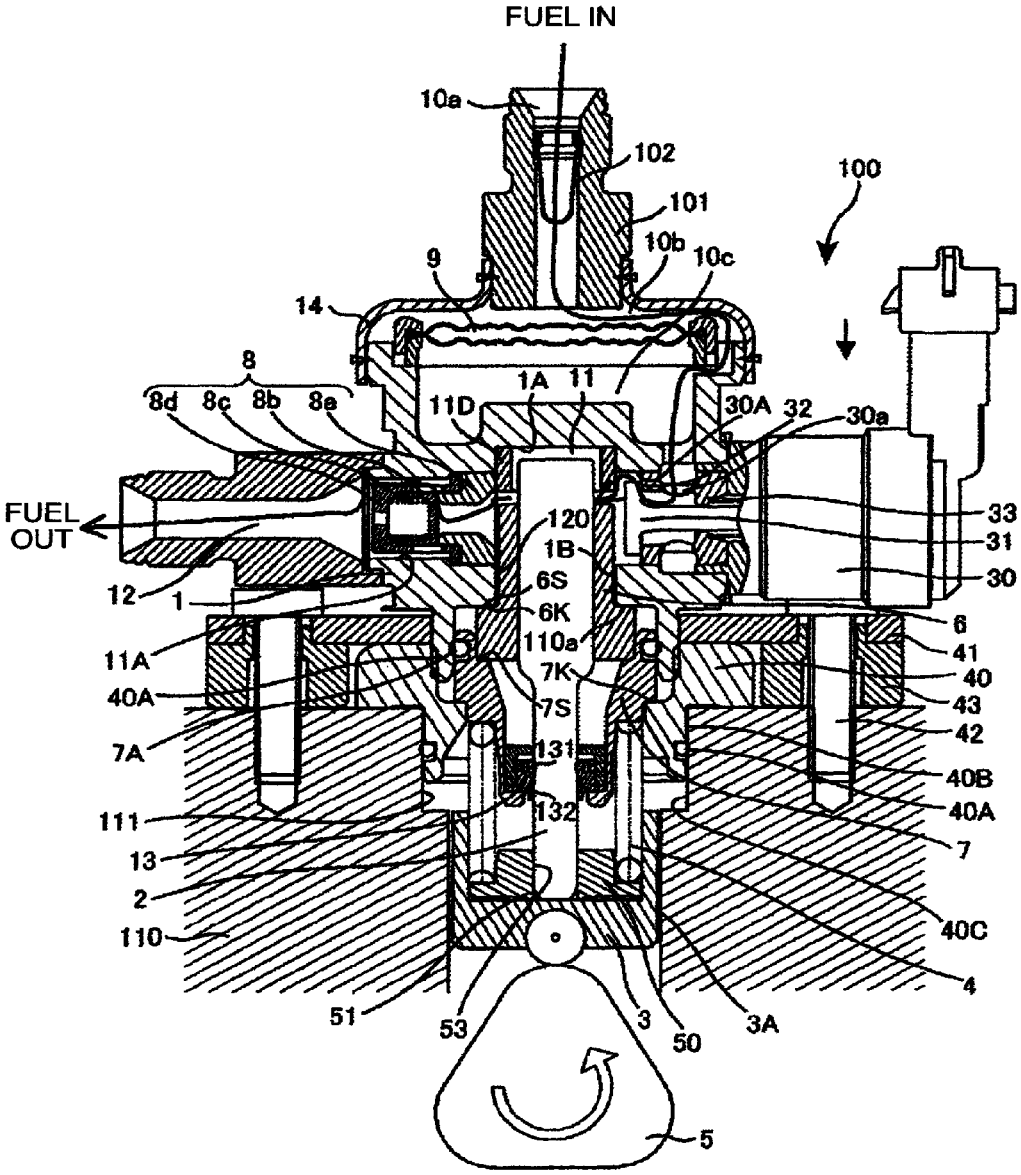
FIG. 1 is a vertical cross sectional view of a high-pressure fuel pump to which the present invention is applied.
Figure 2:
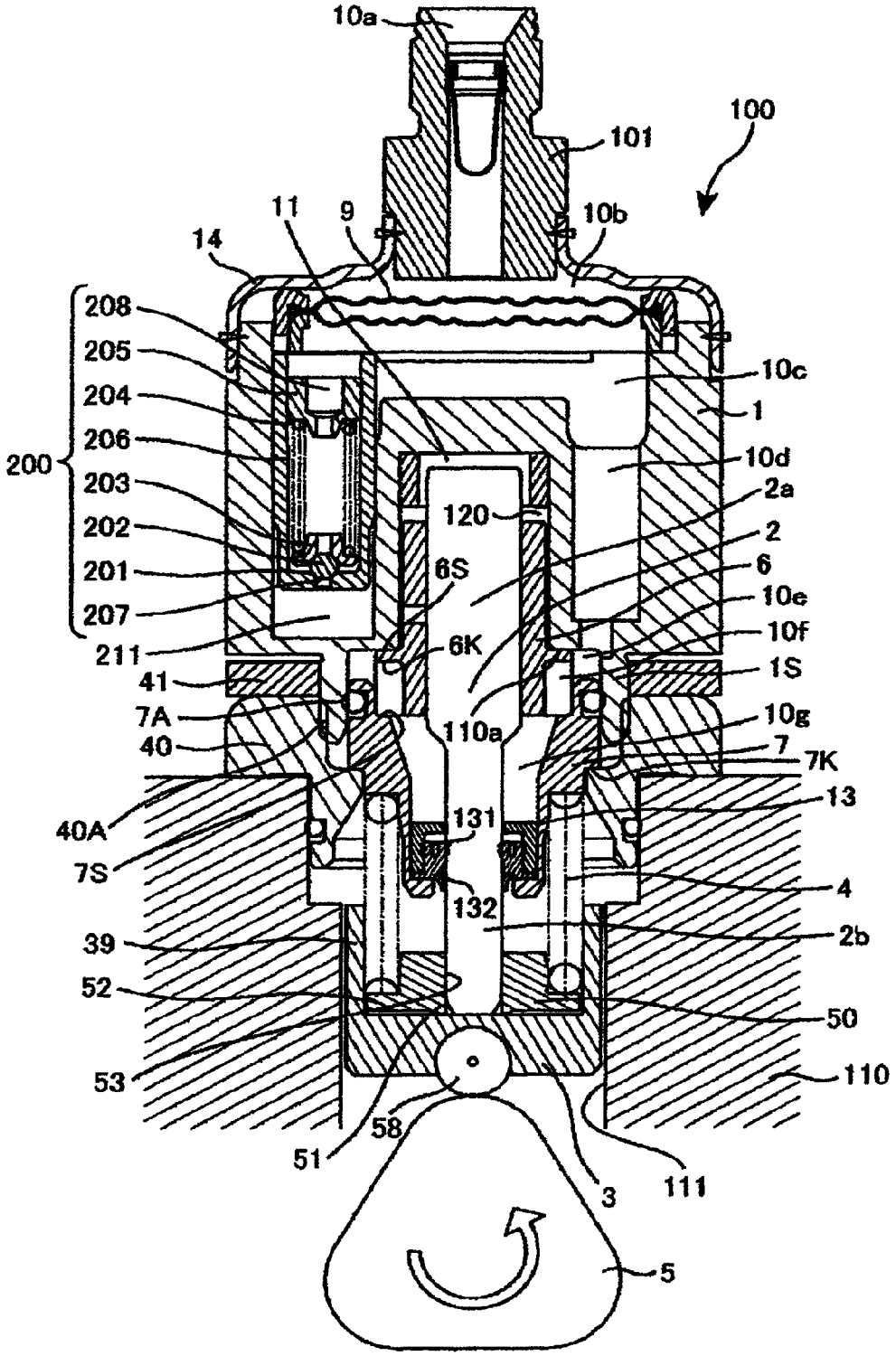
FIG. 2 is a vertical cross sectional view at another angle of the high-pressure fuel pump to which the present invention is applied.
Figure 14:
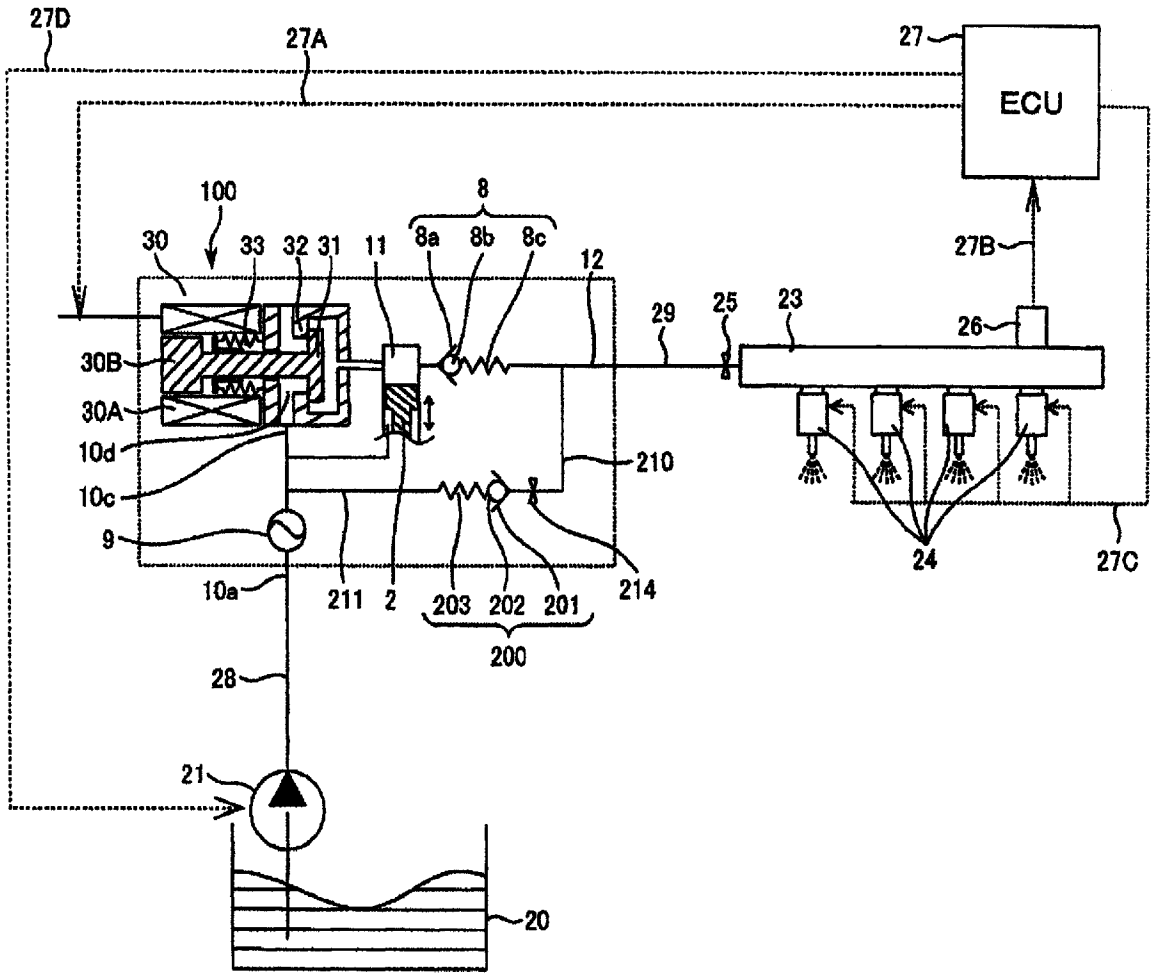
FIG. 14 is a s system view showing a fuel supply system which uses the high-pressure fuel pump.

FIG. 1 is a vertical cross sectional view of a high-pressure fuel pump by which the present invention is executed. FIG. 14 is a drawing showing a fuel supply system which uses the high-pressure fuel pump in FIG. 1.

A fuel which is sucked up by a low-pressure feed pump 21 from a fuel tank 20 is conducted to a fuel intake port 10*a* of a high-pressure fuel pump 100 through an intake piping 28. The low-pressure feed pump 21 is controlled a discharge amount on the basis of a signal 27D of an engine control unit 27 (hereinafter, abbreviated to ECU) in such a manner that a pressure within the low-pressure piping 28 comes to a desired pressure.

The fuel conducted to the fuel intake port 10*a* is conducted to a low-pressure chamber 10*d* through a damper chamber 14 (mentioned below) in which a damper mechanism 9 is installed, and an intake passage 10*c*.

A pressurizing chamber 11 is provided in the pump body 1, and an intake valve 31 and a seat 32 controlling an intake and a shutoff of the fuel in cooperation therewith are provided between the pressurizing chamber 11 and a low-pressure chamber 10*d*.

The intake valve 31 which is energized by a spring 33 in such a direction as to seat on the seat 32 is pushed out by an electromagnetic drive mechanism 30A toward a direction of getting away from the seat 32 against the spring. An electromagnetic drive type intake valve 30 is constructed by the intake valve 31, the seat 32, the spring 33 and the electromagnetic drive mechanism 30A.

In accordance with a downward movement of the plunger 2 on the basis of the rotation of the cam 5, the pressure in the pressurizing chamber 11 comes down, whereby the intake valve 31 overcomes an energizing force of the spring 33 on the basis of a pressure difference between before and after so as to open the valve, and the fuel flows into the pressurizing chamber 11. During a fuel inflow step, an electric current is applied to the electromagnetic drive type intake valve 30 so as to make secure a valve open state. If the cam 5 rotates thereafter, and the electromagnetic drive type intake valve 30 closes the intake valve 31 at a specific timing after the plunger 2 shifts to an upward moving, the intake fuel is pressurized to a high pressure by the plunger 2 which moves up within the pressurizing chamber 11, passes through a high-pressure piping 29 from the fuel discharge port 12, and is pressure fed to a common rail 23 via a stop 25.

A pressure sensor 26 is installed to the common rail 23, and an ECU 27 detects a pressure change within the common rail by monitoring an output of the pressure sensor 26. An injector 24 attached to each of the cylinders of the internal combustion engine is connected to the common rail 23, and the injector 24 directly injects the fuel at an amount demanded by each of the cylinders into the cylinder on the basis of a drive signal from the ECU 27.

Reference symbol 27A denotes an electric power line which feeds a drive electric current to the electromagnetic drive mechanism 30A, reference symbol 27B denotes a signal line which transmits a detection signal of the pressure sensor 26 to the ECU, and reference symbol 27C denotes an electric power line which feeds a drive electric current to the fuel injection valve 24.

The high-pressure fuel pump 10 in accordance with the present embodiment shown in FIG. 1 is provided with all constructing parts within a frame surrounded by a broken line in FIG. 14.

A tubular concave portion forming the pressurizing chamber 11 is formed in the pump body 1, and the pressurizing chamber 11 is formed together with the cylinder 6 which is fixed to the pump body 1 in such a manner that a leading end protrudes out to the tubular concave portion. The plunger 2 is slidably accommodated in the cylinder 6 so as to construct a pressurizing mechanism. As a result that a metal contact portion between an outer peripheral portion of the cylinder 6 and the pump body 1 serves as a metal seal portion with respect to the internal fuel, the plunger 2 reciprocating within the pressurizing chamber 11, the electromagnetic drive type intake valve 30 mentioned above, and a discharge valve mechanism 8 constructed by a seat 8*a*, a discharge valve 8*b* and an energizing spring 8*c* cooperate and can pressurizes the fuel in an inner portion of the pressurizing chamber to about 20 mega Pascal (MPa) or more than it as occasion demands.

The damper mechanism 9 is installed within the fuel passage in the low pressure side, and has such a function as to lower a pulsation of the fuel which is generated within the fuel passage in the low pressure side.

The pulsation of the fuel which is generated within the fuel passage in the low pressure side is generated at a time when the fuel which is temporarily conducted into the pressurizing chamber flows back (or may overflows) to the low pressure chamber 10*d*, by moving up the plunger 2 while keeping the intake valve 31 open, for controlling a discharge amount of the fuel.

The electromagnetic drive type intake valve 30 is provided with a control function of a discharge fuel amount. Specifically, if the cam 5 rotates, and the plunger 2 comes to a descending state, that is, a state of being sucked into the cylinder 6, on the basis of a force of the spring 4, it is attracted to the seat 32 by the spring 33, a differential pressure between a pressure in a side of the low pressure chamber 10*d* of the intake valve 31 under a valve closed state (a feed pressure of the feed pump 21, which is between 1.5 and 4 atmospheric pressure: 0.15 to 0.4 MPa) and the pressure in a side of the pressurizing chamber 11 changes, a force acting in a direction of opening the intake valve 31 becomes finally larger, and the intake valve 31 gets away from the seat 32 against the force of the spring 33 so as to open the valve. In other words, the intake valve 31 is set in such a manner as to overcome an energizing force of the spring 33 so as to open the valve, on the basis of a valve opening force caused by a fluid differential pressure. If the intake valve 31 is opened, the low-pressure fuel is introduced into the pressurizing chamber 11. This state is called as an intake stroke.

If an electric current is supplied to the electromagnetic drive mechanism 30A until the cam 5 further rotates and the plunger 2 shifts to move up, the electromagnetic plunger 30B is exposed to an electromagnetic force in such a direction as to maintain the valve open of the intake valve 31 so as to further compress the spring 33.

Accordingly, even if the cam 5 further rotates and the plunger 2 moves up, the intake valve 31 comes to an open state, and the fuel flows back, that is, is returned to the low-pressure chamber (which may be also called as an overflow). This stroke is called as a return stroke (or an overflow stroke).

At this time, a pressure pulsation is generated in the low-pressure passage 10 by the fuel which is returned to the intake passage 10*c*. The pressure pulsation can be absorbed and reduced by an expansion and contraction of the damper mechanism 9 for the pressure pulsation.

If the electric current supplied to the electromagnetic drive mechanism 30A is shut off, the electromagnetic plunger 30B quickly closes the intake valve 31 at that time point on the basis of the energizing force of the spring 33 and a force of a fluid which acts on the intake valve 31. Further, a compressing action of the fuel by the plunger 2 starts from this time point, and the fuel opens the discharge valve 8*b* at such a time point that the pressure of the fuel becomes higher than the force of the spring 8*c* which energizes the discharge valve 8*b* in the valve closing direction, and is discharged to the discharge port 12 of the pump 100. This stroke is called as a discharge stroke. As a result, the compression stroke of the plunger is constructed by the return stroke and the discharge stroke.

Further, it is possible to control an amount of the discharged high-pressure fuel by controlling a timing which releases the electric current application to the electromagnetic drive type intake valve 30. If the timing which releases the electric current application is quickened, a rate of the return stroke in the compression stroke (the ascending stroke) becomes smaller, and a rate of the discharge stroke becomes larger. In other words, an amount of the fuel which is returned to the low-pressure chamber 10*d* is reduced, and an amount of the fuel which is pressurized and discharged is increased. On the other hand, if the timing which releases the electric current application is delayed, the rate of the return stroke in the compression stroke (the ascending stroke) becomes larger, and the rate of the discharge stroke becomes smaller. In other words, the amount of the fuel which is returned to the low-pressure chamber 10*d* is increased, and the amount of the fuel which is pressurized and discharged is reduced. The timing which released the electric current application, that is, the discharge amount of the fuel is decided by the ECU 27 in correspondence to an operation state of the engine, and is controlled.

In the pump body 1, a cylinder passage 10*b* which is a part of the low-pressure passage 10 is formed in an outer side of the tubular concave portion which forms the pressurizing chamber 11, and the passage 10*b* is provided with a circular opening. The circular opening is sealed by an internal damper cover 14, and is provided in an inner portion thereof with a damper mechanism 9 made of a metal material.

Accordingly, the fuel is introduced via the fuel introduction opening 10*a* which is formed in the pump body 1, the cylindrical passage 10*b* which is provided with the damper mechanism 9 made of the metal material, and the passage 10*c* which is communicated with the low pressure chamber 10*d*.

The electromagnetic drive type intake valve 30 is fixed to the pump body 1 in accordance with a welding, the intake valve 31 is installed in an inlet portion of the pressurizing chamber 11, and the low pressure passage 10*c* is communicated with an opposite side to the pressurizing chamber 11 on the basis of the intake valve seat portion 32.

In the pump body 1, there is further formed a horizontal type tubular concave portion for attaching the discharge valve mechanism 8 which is communicated with the tubular concave portion forming the pressurizing chamber 11. This concave portion is designed smaller in its diameter than a diameter of the horizontal type tubular concave portion for attaching the discharge valve mechanism 8, in such a manner that the discharge valve mechanism 8 can be inserted from the horizontal type tubular concave portion side for attaching the electromagnetic drive type intake valve 30.

After pressure inserting and fixing the discharge valve mechanism 8 to the horizontal type tubular concave portion having the smaller diameter, a tubular metal ring is pressure inserted and fixed to an upper end in an inner portion of the tubular concave portion forming the pressurizing chamber 11, and a part of an outer periphery thereof is opposed to an end portion in a side of the pressurizing chamber of the previously fixed discharge valve mechanism 8, whereby there is provided a function of preventing the discharge valve mechanism 8 from coming off, and a function of enhancing a compression efficiency is provided by reducing the volumetric capacity of the pressurizing chamber.

Next, the cylinder 6 is inserted to the tubular concave portion of the pump body 1 in such a manner that the leading end thereof protrudes out to a tubular concave portion 120 forming the pressurizing chamber 11, and is attached such that an annular seal surface 6S which is formed in an outer periphery of the cylinder 6 comes into contact with a seal surface 110*a* which is formed in the periphery of an opening portion of the tubular concave portion.

Specifically, a seal ring 7A is attached to an outer periphery of a cylinder holder 7, a seal mechanism 13 to which an annular gasoline seal 131 and an oil seal 132 which come into slidable contact with the surface of the plunger 2 are installed so as to be spaced at a predetermined distance in an axial direction is next installed to an inner peripheral portion of the cylinder holder 7, and a lower end side of the plunger 2 is inserted to the seal mechanism 13. Next, the cylinder holder 7 is installed between a lower end outer periphery of the cylinder 6 and an inner periphery of a tubular sleeve 15 of the pump body 1 which protrudes to the periphery thereof, while inserting the leading end of the plunger 2 to the cylinder 6.

At this time, a diameter thereof is set in such a manner that a stepped portion 7S in an inner periphery of the cylinder holder 7 comes into contact with a lower end portion of the cylinder 6.

Further, the cylinder holder 7 is pressed against the lower end of the cylinder 6 by bringing an inner peripheral stepped portion 40A of a fastening holder 40 which is provided in an inner periphery with a screw engaging with a thread formed in an outer periphery of the tubular sleeve 15 into contact with an outer peripheral stepped portion 7K of the cylinder holder 7, and screwing the fastening holder 40 into the tubular sleeve 15, and the pressurizing chamber is sealed by pressing a seal surface 6S of an outer peripheral stepped portion 6K of the cylinder 6 against the lower end seal surface 110*a* of the pump body 1.

The plunger 2 reciprocates in the inner portion of the pressurizing chamber 11, and serves as a so-called pump function which sucks the fuel into the pressurizing chamber 11, makes the fuel overflow from the pressurizing chamber 11 to the low-pressure chamber 10*d*, pressurizes the fuel within the pressurizing chamber, and discharges the pressurized fuel.

The fuel (which is called as a blow-by fuel) leaking from the pressurizing chamber 11 through a gap between the plunger 2 and the cylinder 6 runs into a seal chamber 10*g* which is formed between the seal mechanism 13 and the lower end of the cylinder 6. A seal chamber 10*f* is communicated with the low-pressure chamber 10*c* through a vertical groove 10*f* which is provided in an outer periphery of the cylinder 6, an annular space 10*e* which makes a circuit of the outer periphery of the cylinder 6 which is surrounded by the inner peripheral surface of the pump body 1, the outer peripheral surface of the cylinder 6, the cylinder 7 and the seal ring 7A, and the return passage 10*d* which is formed in a penetrating manner in the pump body 1. In accordance with this, it is possible to prevent the pressure of the fuel reservoir 10*g* from being abnormally increased by the blow-by fuel, and adversely affecting the seal mechanism.

Further, the seal mechanism 13 provided in the outer periphery of the lower end portion of the plunger 2 prevents the fuel from leaking to the outer portion, and also prevents the lubricating oil lubricating the contact portion between the cam 5 and the tappet 3, and between the tappet 3 and the plunger 2 from flowing into the fuel passage such as the pressurizing chamber 11, the lower pressure chamber 10*d* and the like.

Further, the pump body 1 is provided with a relief mechanism 200 which prevents the common rail 23 from coming to an abnormally high pressure. The relief mechanism 200 is constructed by a relief valve seat 201, a relief valve 202, a relief presser foot 203, and a relief spring 204, and is arranged in relief passages 210 and 211 which are branched from a high-pressure passage between a downstream of the discharge valve mechanism 8 and the discharge port 12 so as to run into the low-pressure fuel passage 10*c*. If the pressure in the high-pressure fuel passage including the common rail 23 is going to come to an abnormally high pressure, the pressure is transmitted to the relief valve 201, and the relief valve 201 gets away from the relief valve seat 201 against a force of the relief spring 204, and relieves the abnormally high pressure to the intake passage, thereby preventing the high-pressure piping 29 and the common rail 23 from being damaged. In this case, since it is structured such that the abnormally high pressure is transmitted via a stop 214, the relief valve 202 does not open in a high-pressure state for an extremely short period which is generated at a time of discharging. In accordance with this, an erroneous operation is prevented.

An installation of the high-pressure fuel pump 100 to an engine head 101 is carried out by fastening in common an attaching bracket 41 between a fastening holder 40 and the pump body 1, and fixing the attaching bracket 41 to the engine head 101 in accordance with a screwing. A cylindrical bush 43 having a through hole for a bolt is integrated in the attaching bracket 41 by being caulked.

The spring 4 which comes into contact with the lower end of the cylinder holder 7 in its one end is retained in its another end by a spring receiving retainer 50 which is attached to the lower end of the plunger, and the tappet 3 is put on the retainer 50 from the below of the drawing. Next, the lower end portion of the plunger 2 is inserted to an attaching hole 111 of the engine head 101 to such a position that the roller 58 of the tappet 3 comes into contact with the peripheral surface of the cam 5, by using the outer periphery 3A of the tappet 3 as a guide, and there is sealed between an outer periphery 40B of the fastening holder 40 and an inner peripheral surface 40C of the attaching hole by a seal ring 40A which is provided in an outer periphery of the fastening holder 40. Finally, the attaching bracket 41 is fixed by screw to the engine head 101 by a screw 42, and the fastening holder 40 is pressed against the surface of the engine so as to be fixed.

In this case, a description will be given of a matter than the plunger 2 has a larger diameter portion and a smaller diameter portion. The plunger 2 is constructed by a larger diameter portion 2*a* which slides with the cylinder 6, and a small diameter portion 2*b* which slides with the plunger seal 13. A diameter of the smaller diameter portion 2*b* is set to be smaller than the diameter of the larger diameter portion 2*a*, and they are set coaxially with each other. In the case of the present embodiment, the diameter of the larger diameter portion 2*a* is set to 10 mm, and the diameter of the smaller diameter portion 2*b* is set to 6 mm. The following several advantages can be obtained by setting the larger diameter portion and the smaller diameter portion in the plunger as mentioned above. One is a reduction of the pulsation of the low pressure side pressure. In the pulsation which is generated in accordance with the upward and downward motion of the plunger 2, it is possible to reduce the pressure pulsation which is generated in an upstream side of the electromagnetic drive type intake valve 30. The pressure pulsation which is generated in the upstream side of the electromagnetic drive type intake valve 30 is a factor deteriorating various performances, for example, it may cause a noise, it may deteriorate a durability of the feed pump 21, it may deteriorate a durability of the low-pressure piping 28 itself, and the like. The second advantage is downsizing the diameter of the plunger seal 13 in accordance with the plunger small diameter portion 2*b*. In accordance with an advantage caused by the downsizing, since a fuel seal length in a peripheral direction with respect to the plunger 2 becomes shorter, there are such advantages as it is possible to further reduce the leading amount from the seal portion, it is possible to reduce a friction heat with respect to the plunger 2, a weight can be saved, a cost can be reduced and the like.

There are many advantages obtained by having the larger diameter portion and the smaller diameter portion as mentioned above, however, a strength is necessary in the plunger 2 since it is exposed to a compression reaction force of the pressurizing chamber 11, and a further strength is demanded from needs of a high pressure structure and a large capacity structure in recent years. Therefore, in the structure in which the smaller diameter portion of the plunger 2 is provided with the further smaller diameter neck as shown in FIG. 1 of JP-A-2001-295770, the strength of the plunger comes into question.

Figure 3:
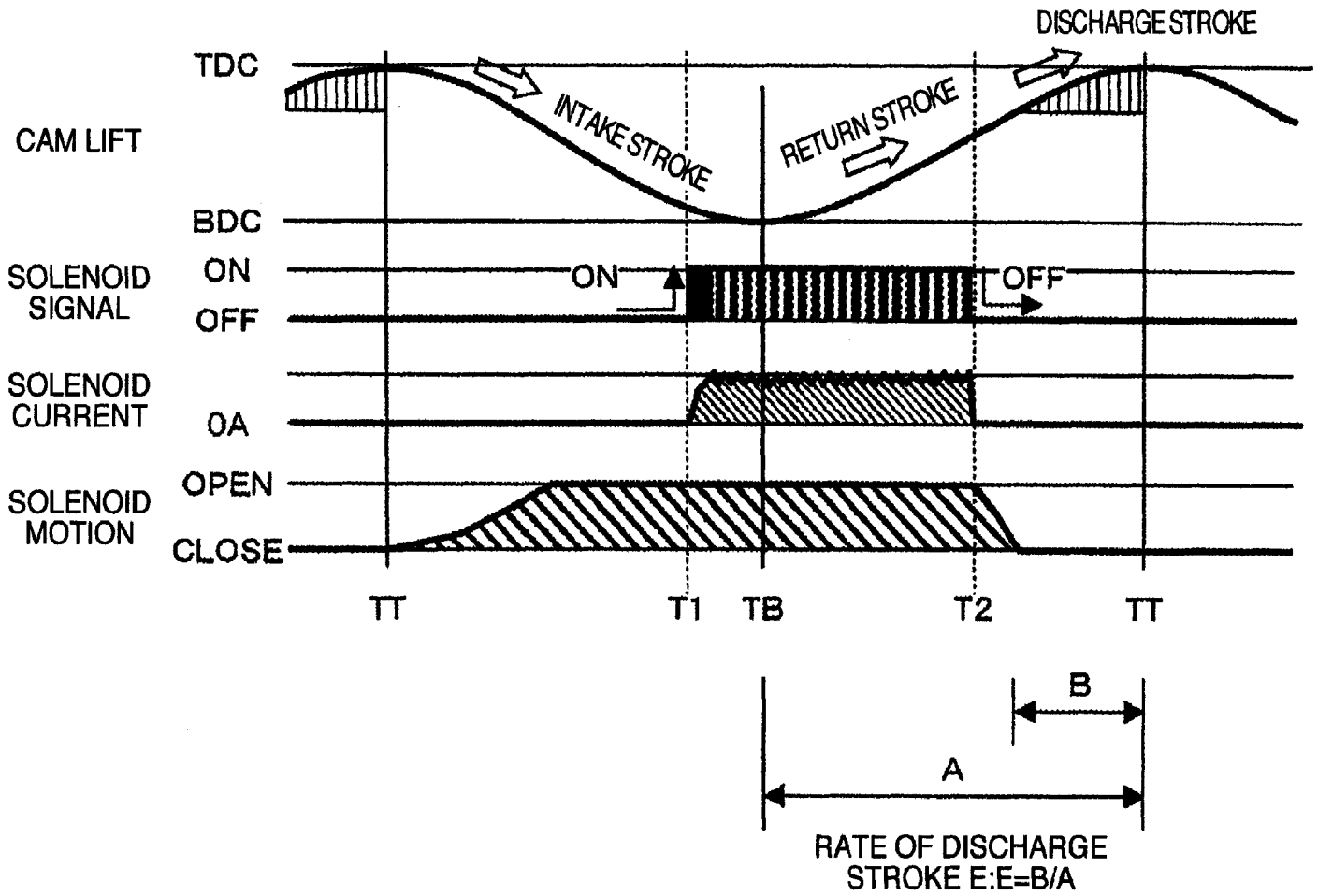
FIG. 3 is a diagram showing an operating step of the high-pressure fuel pump to which the present invention is applied.

FIG. 3 is a diagram in which a horizontal axis is set to time, and explains in brief a step at a time when the pump reciprocates at one time, and a motion of a solenoid serving as the electromagnetic intake valve.

[Intake Step]

At a time instant TT, the plunger 2 is at a top dead center, that is, in a state in which the volumetric capacity of the pressurizing chamber 11 is the smallest, and the volume of the seal chamber 10*g* is the largest. In accordance with the rotation of the cam 5, the plunger 2 starts moving down on the basis of a compression reaction force of the spring 4. If the plunger 2 starts moving down, the pressure in the pressurizing chamber 11 is reduced on the basis of an increase of the volumetric capacity of the pressurizing chamber 11, and the intake valve 31 overcomes the energizing force of the spring 33 so as to open the valve, on the basis of the difference from the pressure within the electromagnetic drive type intake valve 30. In this intake step, the fuel flowing into the pressurizing chamber 11 is not limited to the fuel from the intake port 10*a*, but include the fuel caused by a volume reduction of the seal chamber 10*g* due to the motion of the plunger 2. Accordingly, since a flow rate from the intake port 10*a* can be made smaller in comparison with the high-pressure fuel pump having the plunger which does not have the larger diameter portion and the smaller diameter portion, it is possible to reduce the pressure pulsation which is generated in the upstream side of the electromagnetic drive type intake valve 30.

In preparation for the next return step and the discharge step, the electric current is fed to the electromagnetic drive type intake valve 30 from the side of the ECU at a time instant T1, and the electric current energizes the force to a side opening the intake valve 31 by the solenoid 30*b*, and makes secure the valve open state.

[Return Step]

At a time instant TB, the plunger 2 is at a bottom dead center, that is, in a state in which the volumetric capacity of the pressurizing chamber 11 is the largest, and the volume of the seal chamber 10*g* is the smallest. In accordance with the rotation of the cam 5, the plunger 2 is pushed up via the roller 58 and the tappet 3 so as to start moving up. If the plunger 2 starts moving up, the fuel in the pressurizing chamber 11 moves in a direction which is absolutely opposed to the intake step in accordance with a reduction of the volumetric capacity of the pressurizing chamber 11. In other words, the fuel in the pressurizing chamber is not only returned to the intake port 10*a*, but also returned to the seal chamber 10*g* through the fuel passage 10*d* on the basis of a volume increasing amount of the seal chamber 10*g* due to the motion of the plunger 2.

In accordance with the same thought as the intake step, since a flow rate returning to the outer portion of the pump, that is, to the upstream from the intake port 10*a* can be made smaller, in comparison with the high-pressure fuel pump having the plunger 2 which does not have the larger diameter portion and the smaller diameter portion, it is possible to reduce the pressure pulsation which is generated in the upstream side of the electromagnetic drive type intake valve 30.

[Discharge Step]

In the ECU 27, in order to obtain a desired discharge flow rate, a time instant T2 is calculated, and the electric current applied to the electromagnetic drive type intake valve 30 at the time instant T2 is shut off. The intake valve 31 which is energized by the electromagnetic force until the time instant T2 so as to be open starts closing the valve on the basis of a compression reaction force of the spring 33, and the force of the fluid which passes through the intake valve 31 and the seat 32. After completely finishing the valve close, the pressure rises on the basis of the reduction of the volume within the pressurizing chamber caused by the rise of the plunger within the pressurizing chamber, and there comes the discharge step by pushing out the discharge valve 8*a*. The discharge step is continuous until the plunger 2 comes to the top dead center.

In this discharge step, the volume in the seal chamber 10*g* is increased. In accordance with the increase of the volumetric capacity of the seal chamber 10*g*, the fuel flows into the seal chamber 10*g* from the discharge port 10*a*.

Figure 4:
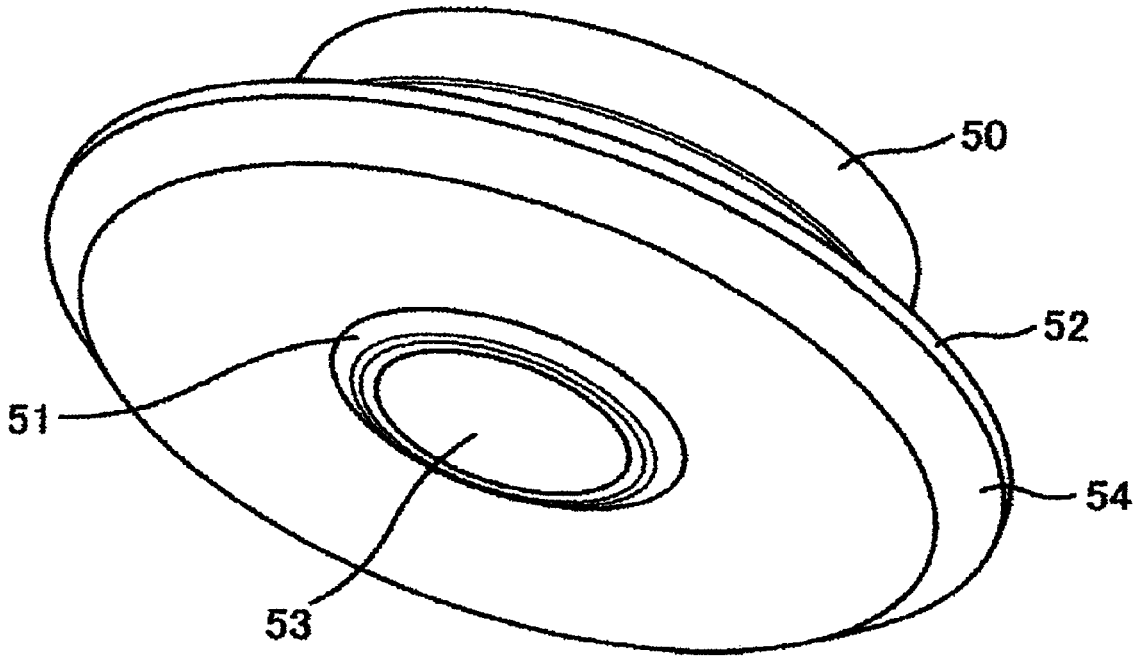
FIG. 4 is a three-dimensional perspective view of a retainer which comes to one embodiment in accordance with the present invention.

In this case, a description will be given in detail of the retainer 50 in accordance with the present invention with reference to FIG. 4 to FIG. 6.

The function of the retainer 50 is to transmit a force Fs of the spring 4 which generates the force moving down the plunger 2 to the plunger 2. In other words, as a motion of the plunger, an upward movement of the plunger 2 is actuated by the rotating force of the cam 5 being transmitted to the plunger 2 via the roller 58, and the tapper 3 to which the roller 58 is attached, and a downward movement of the plunger 2 is actuated by the spring force Fs being transmitted to the plunger 2 via the retainer 50 so as to push down the tappet 3 and the roller 58.

The retainer 50 is formed as an annular shape, and has a collar portion 52 which comes into contact with a seat surface in a lower end portion of the drawing of the spring 4 and receives the spring force Fs, and a through hole 53 for being pressure inserted and fixed in a close fit manner to a lower end of the smaller diameter portion 2*b* of the plunger 2, while having a body portion coming to a guide in an inner diameter side of the spring 4 as a main body. Further, in order to avoid a contact with an actuating portion of the spring 4, the retainer 50 except a seat winding portion of the spring is formed as a taper shape 57 in such a manner as to becomes smaller than a diameter of the seat winding portion of the spring.

A projection 51 which is a main part of the present invention is provided in a surface which is opposed to the tappet 3 in the retainer 50. In the present embodiment, the projection 51 is provided annularly in such an aspect as to surround the through hole 53 of the retainer 50.

The fixing between the retainer 50 and the plunger 2 can be achieved by pressure inserting and fixing the lower end of the smaller diameter portion 2*a* of the plunger to the through hole 53 in accordance with a close fit. A fixing force Fa between the retainer 50 and the plunger 2 is caused by a tension force which is obtained by an elastic or plastic deformation of the mutual parts on the basis of a dimensional difference between an inner diameter of the through hole 53 of the retainer 50 and an outer diameter of the smaller diameter portion 2*b* of the plunger 2 before the retainer 50 and the plunger 2 are assembled, that is, a fastening margin.

This fixing force Fa is an unstable force initially and with age. There is initially such a defect that the fixing force is dispersed widely due to a manufacturing precision of each of parts. It is greatly changed by a precision of a roundness or a cylindricality in a hole and a shaft of each of the parts in addition to a simple precision of the diameter, a surface roughness, a cleaned state, and a lubrication. A method of controlling the fixing force by measuring the pressure inserting force at a time of assembling is general, however, in the case that a bur or a foreign material of the part is bitten into the pressure insertion surface, or a pressure inserting jig is defective, there is a possibility that the fixing force and the pressure inserting force are different, and it lacks a reliability.

With age, an amount of thermal expansion and an amount of thermal contraction of each of the members are different on the basis of a difference of a coefficient of linear expansion of the respective materials of the plunger 2 and the retainer 50, or a temperature difference of the respective parts, and an extremely small relative movement is generated in the pressure insertion contact surface, whereby there is a risk that the fixing force is weakened. Further, there can be thought that the fixing force is reduced by a repeated application of the external force (the force of the spring and the force in the lateral direction generated in the friction surface of the plunger and the tappet) applied to the retainer 50 and the plunger 2 to the pressure inserted and fixed surface.

In this case, a description will be given in detail of the force acting on the retainer 50 by separating into a downward moving step (an intake step) and an upward moving step (a return and discharge step) of the plunger 2.

Figure 5:
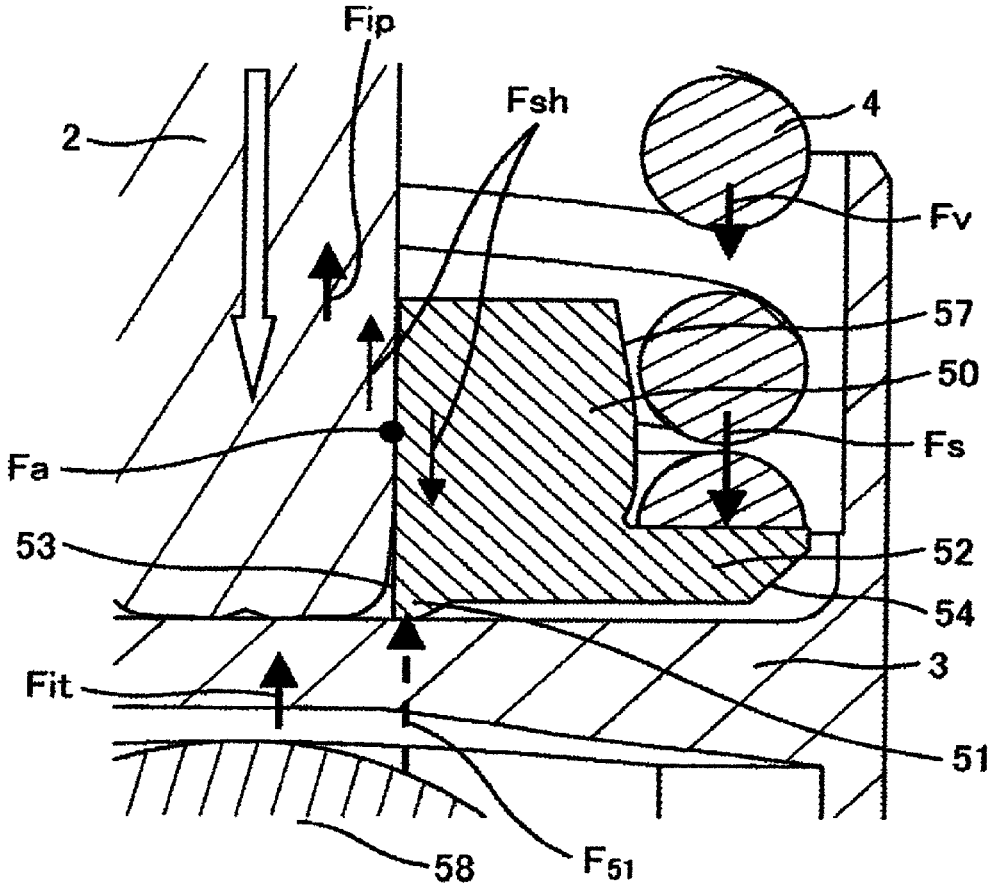
FIG. 5 is a view for describing a force which acts on the retainer at a time of a descending step of the plunger.
Figure 6:
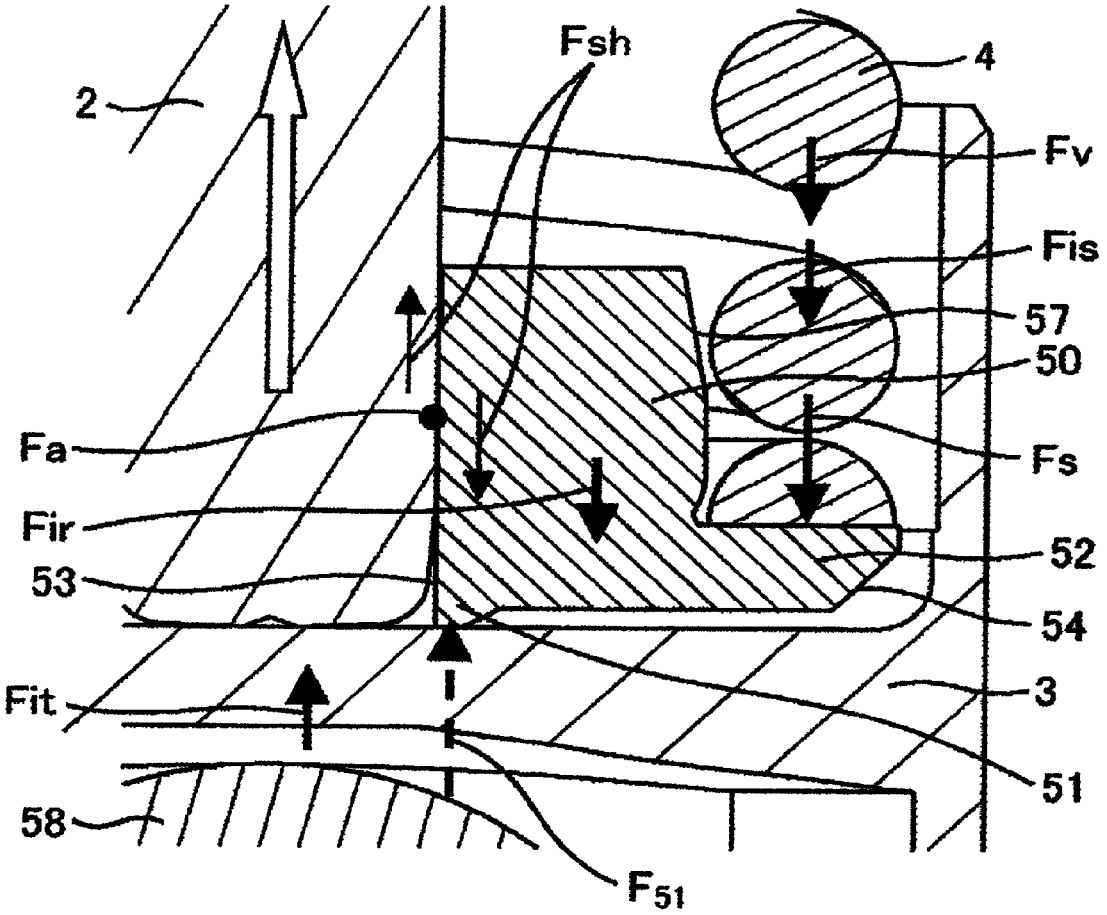
FIG. 6 is a view for describing a force which acts on the retainer at a time of an ascending step of the plunger.

First of all, in the downward moving step, since the force Fs by which the compressed spring 4 is going to expand acts on the retainer collar portion 52, four forces mentioned next act in a direction of pulling out the retainer 50 from the plunger 2, that is, in such a direction as to generate a shear force Fsh so as to move the retainer 50 in a downward direction and move the plunger 2 in an upward direction in FIG. 5.

The first force is constructed by inertia forces Fip and Fit by which the plunger 2 and the tappet 3 are going to stay at their original positions. The second force is constructed by a friction force Fft (which is not illustrated) of the plunger seal 13 which is installed annularly while having a tensile force in the plunger 2. The third force is constructed by a force Fp (which is not illustrated) caused by the pressure difference among the pressurizing chamber, the seal chamber and the cam chamber, which may act on the plunger 2 in a direction of energizing in the same manner as the force in the shear direction. The fourth force is constructed by an inertia force Fv of the spring caused by the engine vibration. On the basis of these matters, it is necessary that the fixing force Fa of the plunger 2 and the retainer 50 is set as follows.

$$Fa > Fsh = (Fip + Fit + Ffp + Fp + Fv \times \text{safety ratio} \quad (1)$$

Next, a description will be given of the upward moving step with reference to FIG. 6. In the upward moving step, the force acts on the lower end of the plunger 2 via the tappet 3 in accordance with the rotation of the cam 5, and the plunger 2 moves up. In accordance with the upward movement of the plunger 2, the spring 4 is compressed and the spring force Fs acts on the retainer 50. Even in this case, the spring force Fs is applied in the direction in which the plunger 2 pulls out the retainer 50, that is, in such a direction as to generate a shear force as to move the retainer 50 in the downward direction and move the plunger 2 in the upward direction in FIG. 6. Further, the inertia forces Fir and Fis by which the retainer 50 and the spring 4 are going to stay there act on the force in the shear direction in the energizing direction in the same manner. Further, in the same manner as the downward moving step, the inertia force Fv caused by the engine vibration of the spring acts. Since Fp generated in the pressurizing chamber 11 in the upward moving step is received by the plunger 2, it does not come to a factor of Fsh. In accordance with these matters, it is necessary that the fixing force Fa of the plunger 2 and the retainer 50 is set in such a manner as to satisfy the following expression.

$$Fa > Fsh = (Fs + Fir + Fis + Fv) \times \text{safety ratio} \quad (2)$$

In the meantime, as mentioned above, the fixing force Fa is a very unstable force. If the external force Fsh is applied in a state in which the fixing force Fa is weakened as mentioned above, the connection portion between the plunger 2 and the retainer 50 is loosened, the retainer 50 moves closer to the tappet 3 than the initial position, and comes into contact with all the surface of the gap with the tappet 3, whereby not only an excessive moment mentioned later acts on the plunger 2 so as to cause a sticking and a galling with respect to the cylinder 6, but also there is a risk that the plunger 2 is broken at the neck portion of the connection portion between the larger diameter portion 2*a* and the smaller diameter portion 2*b*.

In order to prevent these fixing forces from becoming unstable, it is general to add such a step as a welding step and a caulking step to the fixing between the plunger 2 and the retainer 50, however, this is not economical.

In this case, in the first embodiment, the annular projection 51 is installed around the plunger through hole 53 of the retainer 50. In the case that the projection 51 is not provided, it is necessary to retain all the external force Fsh such as the spring force Fs and the like mentioned above by the fixing force Fa of the pressure insertion portion, however, in the case that the projection 51 is provided, it is possible to have charge of most of Fsh by the force F51 which the projection 51 is applied by coming into contact with the tappet 3.

In the intake step, it is possible to have charge of the inertia force Fv caused by the engine vibration of the spring in addition to the inertia force Fit of the tappet which is the largest in the shear forces, on the basis of the contact of the projection 51 provided in the retainer 50 with the tappet 3, and the load of the fixing force Fa is reduced. In other words, the expression (1) mentioned above which indicates the necessary fixing force can be changed to the following expression (3).

$$Fa>Fsh=(Fip+Ffp+Fp)\times\text{safety ratio}$$

$$F51=Fit+Fv \tag{3}$$

Further, in the discharge step, since it is possible to have charge of all the shear force Fsh on the basis of the contact of the projection 51 provided in the retainer 50 in accordance with the present invention with the tappet 3, the fixing force Fa is not necessary theoretically. In other words, the expression (2) indicating the necessary fixing force Fa can be changed to the following expression (4).

$$Fa>Fsh=0+\text{margin of safety}$$

$$F51=Fs+Fir+Fis+Fv \tag{4}$$

In accordance with them, the necessary fixing force Fa can be made extremely small and it is possible to set the safety ratio with respect to the coming off high, by providing the projection 51 in the retainer 51.

Figure 7:
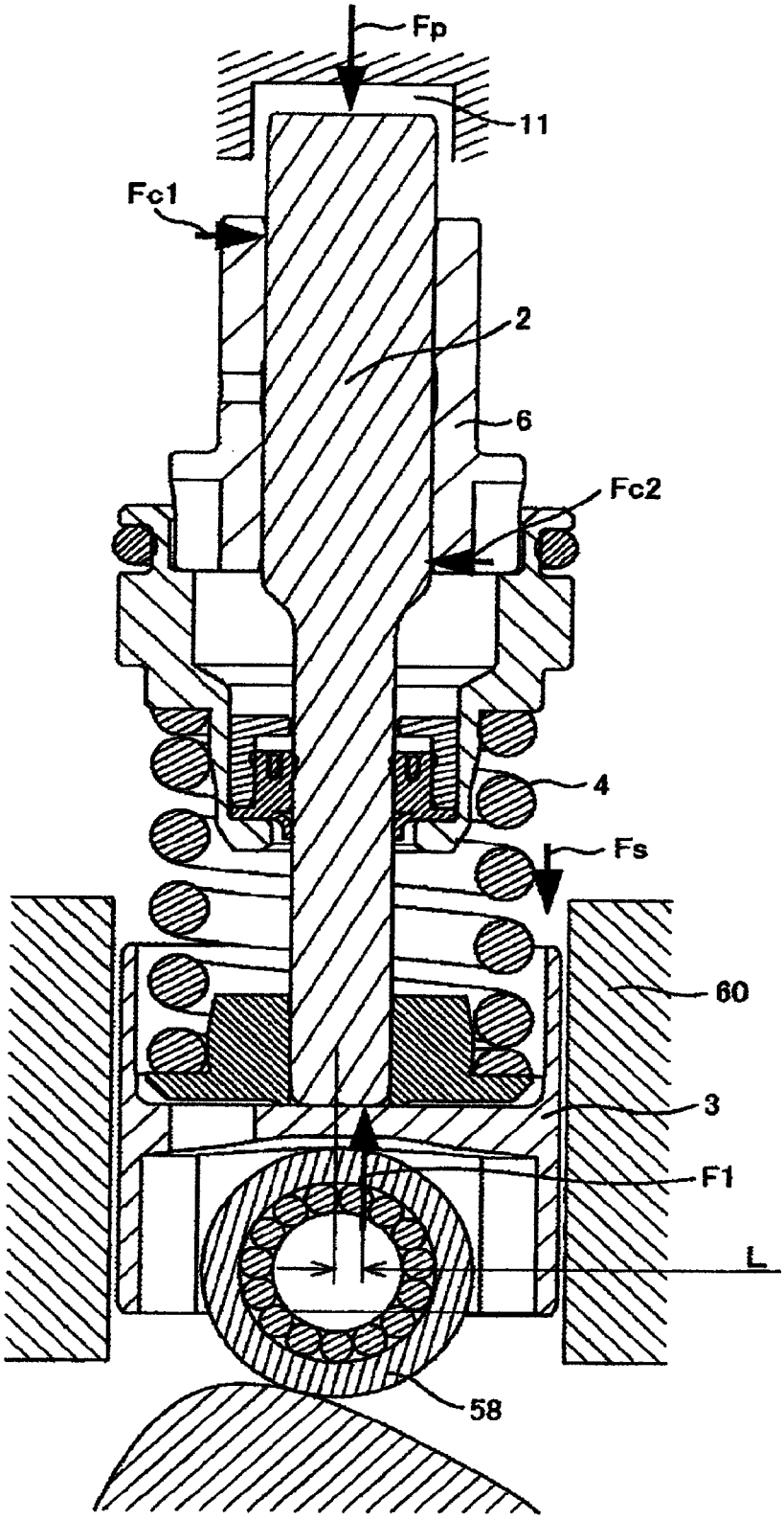
FIG. 7 is a view showing an axial force which acts on the plunger and an acting force on the cylinder.

A description will be given below of a motion of the pressurizing mechanism and a problem thereof. FIG. 7 shows the pressurizing mechanism portion by picking up from FIG. 1, and the force application is as mentioned above.

If the intake valve 31 is closed by disconnecting the current application of the electromagnetic drive mechanism 30A in the upward moving stroke of the plunger 2, the pressurizing chamber 11 comes to the pressurizing stroke of the fuel. In the pressurizing stroke, the fuel within the pressurizing chamber 11 is rapidly compressed and pressurized. If the pressurizing chamber 11 is pressurized so as to come to the high pressure, the force Fp acts as the compression reaction force on the plunger 2 in the axial direction of the plunger 2 in such a manner as to be pinched by the pressurizing chamber 11 and the tappet 3. Further, an axial force F1 obtained by combining the force Fp, the compression reaction force Fs of the spring 4, the inertia force of the plunger 2 and the like is applied to the lower end of the plunger 2 on the basis of the contact with the tappet 3.

It is ideal that the axial force F1 is applied only to the vertical direction, however, the axial force F1 generates a lateral force (a side force) acting in the vertical direction to the axial direction of the plunger 2 on mechanism. A main reason of the lateral force (the side force) generated from the axial force F1 is mentioned later in detail, however, is a bending moment to the plunger 2 which is generated by a distance L between the center axis of the plunger 2, and a point at which the plunger 2 and the tappet 3 actually come into contact.

A component of the lateral force (the side force) of the plunger 2 is applied to the cylinder inner surface of the cylinder 6. The forces of the contact force Fc1 in the upper end portion of the cylinder 6 and the contact force Fc2 in the lower end portion are generated in the inner peripheral surface of the cylinder 6 in such a manner as to balance with the bending moment mentioned above. The increase of the contact forces Fc1 and Fc2 comes to a reason whey the contact surface pressure of the plunger 2 and the cylinder 6 is increased so as to increase a deterioration of the sliding performance.

Accordingly, the projection 51 in accordance with the embodiment is a structure having a high reliability with regard to the fixing between the plunger 2 and the retainer 50.

Figure 8:
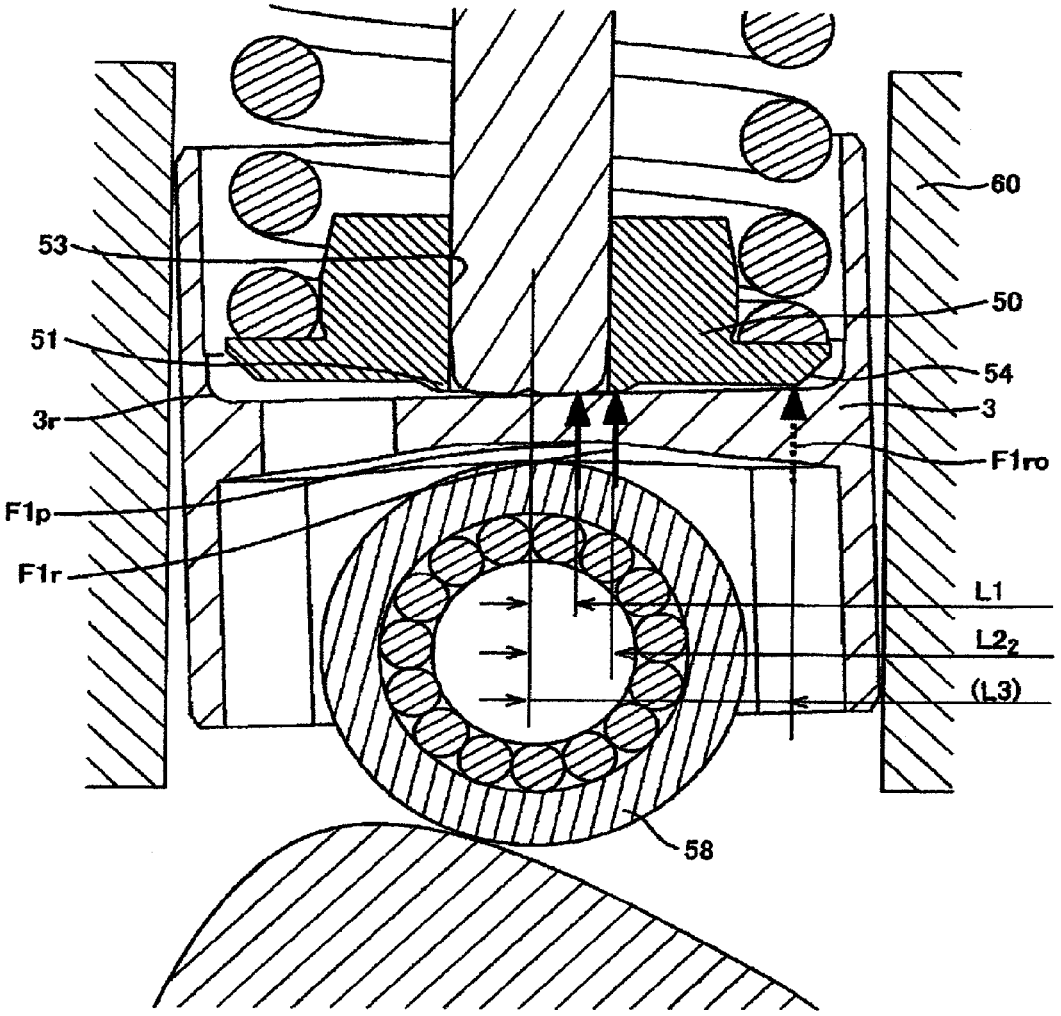
FIG. 8 is a view showing a moment which acts on the plunger.

Further, a description will be in detail given below of an embodiment in which the sliding performance of the plunger 2 and the cylinder 6 becomes further better with reference to FIG. 8.

In the pressurizing step, the plunger 2 is exposed to the compression reaction force Fp in the pressurizing chamber 11 which comes to the high pressure. The force is large, for example, it goes beyond 2 kN to the maximum. Further, taking into consideration a market need of a high pressure structure and a great capacity structure in the future, it comes to the further larger compression reaction force.

Since the projection 51 is provided in the retainer 50, the compression reaction force Fp and the other resultant force F1 in the axial direction of the plunger including Fp are received by the load F1*p* and the load F1*r* which are generated in the plunger 2 and the projection 51 of the retainer 50 which come into contact with the tappet 3.

$$F1=F1p+F1r \tag{5}$$

If the load can be received by a whole periphery of the plunger 2 and the projection 51 ideally, there is no problem, however, the plunger 2 and the tappet 3 come into contact at a point which gets away at a distance L1 from the center axis of the plunger and the retainer 50 and the tappet 3 come into contact by a portion of the projection without coming into contact by a whole periphery of the annular projection, that is, the portion which gets away at a distance L2 from the center axis of the plunger, due to a micro incline of the tappet itself caused by a micro gap between the tappet 3 and the cylinder head 60 serving as the outer peripheral guide of the tappet 3, or a micro incline of the pump and the plunger 2 itself At this time, the distances L1 and L2 from the center axis of the plunger 2 generate the bending moment with respect to the plunger 2, and the bending moment with respect to the plunger 2 is applied to the cylinder. In other words, the bending moment M applied to the plunger 2 is as follows.

$$M=F1p\times L1+F1r\times L2 \tag{6}$$

The moment in the case that the projection 51 is not installed is as follows.

$$M=F1(=F1p+F1r)\times L1 \tag{7}$$

Accordingly, a difference between the expression (6) and the expression (7) comes to the moment which is increased by the projection 51.

$$M=F1r\times(L2-L1) \tag{8}$$

This bending moment is such a problem as to be directly connected to the problem which the sliding portion mentioned above has. Therefore, it is necessary to make the bending moment as small as possible, and the following device is carried out.

Figure 9:
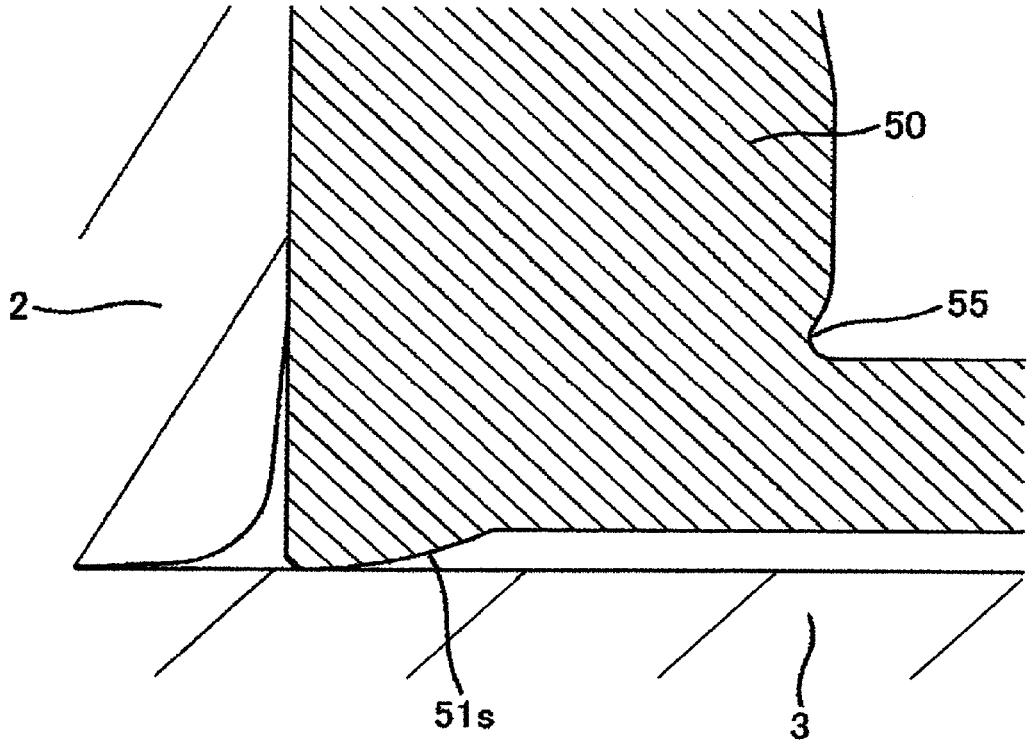
FIG. 9 is a partly enlarged cross sectional view showing another variation of a retainer projection shape.

The first device is to make the diameter of the annular projection as small as possible. The distance L2 becomes smaller by making smaller, and it is possible to make the bending moment smaller. Since the moment is generated in the outermost diameter portion of a flat surface at a time when the retainer projection 51 has the flat surface so as to be opposed to the tappet 3, an outer diameter of the flat surface portion of the projection 51 is made smaller. Alternatively, the annular projection is formed such a spherical shape 51*s* as to convex in the center as shown in FIG. 9, and is brought into contact with the tappet 3 as close as possible to the center axis of the annular projection, thereby making the moment small. Further, the projection 51 may be structured such as to combine the flat surface and the spherical surface.

The second device is to soften the material of the retainer itself. The soft means that a rigidity is small (a low rigidity) and also means that a hardness is small (a low hardness).

The bending moment acting on the plunger is generated by the reason why the plunger 2 and the projection 51 of the retainer 50 respectively have the distance from the center axis of the plunger in the contact point with the tappet 3, as shown by the expression (6). If the bending moment M is compared on the basis of the magnitude of the rigidity of the projection 51, the component force F1*r* is larger in the component forces F1*p* and F1*r* of the force F1, that is, the moment M is larger in the case that the rigidity is larger, and the load F1 acts more on the plunger side at such a degree that the projection 51 deforms so as to escape from the tappet 3 in the case that the rigidity of the projection 51 is smaller, whereby the component force F1*r* becomes smaller (the component force F1*p* becomes larger), that is, the moment M becomes smaller. In accordance with this matter, it is advantageous to reduce the rigidity of the material of the retainer 50. Further, in the case that F1*r* is too large, the plunger 2 receives much of the load F1 even if the projection temporarily plastically deforms beyond the breakage load of the projection 51, and there is accordingly no problem on the function of the pump. In the same meaning, the hardness of the retainer projection portion 51 may be made smaller, and the projection portion may be worn out positively in the portion in which the projection portion of the retainer 50 interferes with the tappet 3 along the incline of the tappet 3.

The third device is to structure the annular projection coaxially with the plunger 2. Whatever direction the pump 100 is attached around the plunger 2, or whatever direction the tappet 3 is inclined, the distance L2 becomes constant.

In the case of the retainer in which the projection 51 is not installed, the fixing force between the plunger 2 and the retainer is reduced as mentioned above, the retainer moves closer to the tappet side than the initial position of the retainer with respect to the plunger, and there is a risk that the tappet 3 and the outer periphery of the retainer 50 come into contact. In this case, the bending moment acting on the plunger is M=F1*ro*×L3, and the moment which is extremely larger (for example, twice or more) than the moment in the case that the projection 51 is provided acts on the plunger 2, that is, is applied to the cylinder 6 of the plunger 2. Alternatively, the loads Fc1 and Fc2 applied to the plunger 2 from the cylinder 6 are increased, thereby causing a sticking and a galling, and there is further a risk of such a great problem that the plunger 2 is broken and the fuel leaks out to the outer portion.

As another feature of the retainer 50, a chamfer 54 is applied to a side which is opposed to the tappet in an outer peripheral portion of the retainer 50. A corner portion R of a concave space receiving the plunger 2 in the tappet 3 has a comparatively large R shape 3*r* for improving a workability of the tappet and securing a strength. On the other hand, it is desirable that the retainer 50 of the pump secures a seat surface diameter as large as possible for improving a design freedom of the spring 4. The chamfer 54 bears a part in compatibility of demands of the tappet side and the pump side.

Taking into consideration a case that the angle R (an angular chamfer) in the inner diameter side of the end portion seat winding of the spring 4 is small, it is necessary to make the corner R or the retainer corner portion corresponding to the angular chamfer portion small. It is provided for preventing the spring seat winding from running on the retainer corner portion. In the case that it is demanded to make a dimension of the retainer corner portion R large while taking into consideration a service life of a cutting tool, in the manufacturing of the retainer, the corner R is constructed by a shape 55 which cuts into the inner diameter side, as shown in FIG. 9. In accordance with this, it is possible to further reduce the lateral force (the side force) acting on the plunger by preventing the spring angle R from running on the retainer corner R.

As a material of the retainer 50, it is preferable that it is constructed by a material in which a coefficient of thermal expansion is equal to or similar to the plunger 2, in the case of being fixed by a pressure insertion to the plunger 2. Further, as mentioned above, in order to make the bending moment to the plunger 2, the bending moment can be made smaller by constructing by a material in which a rigidity is smaller or a hardness is smaller than the plunger 2.

Since the shape of the retainer 50 can be made simple various manufacturing methods can be thought. It may be shaved out of a rod material or may be constructed by a forging. Further, a similar shape may be press molded from a sheet material.

Embodiment 2

Figure 10:
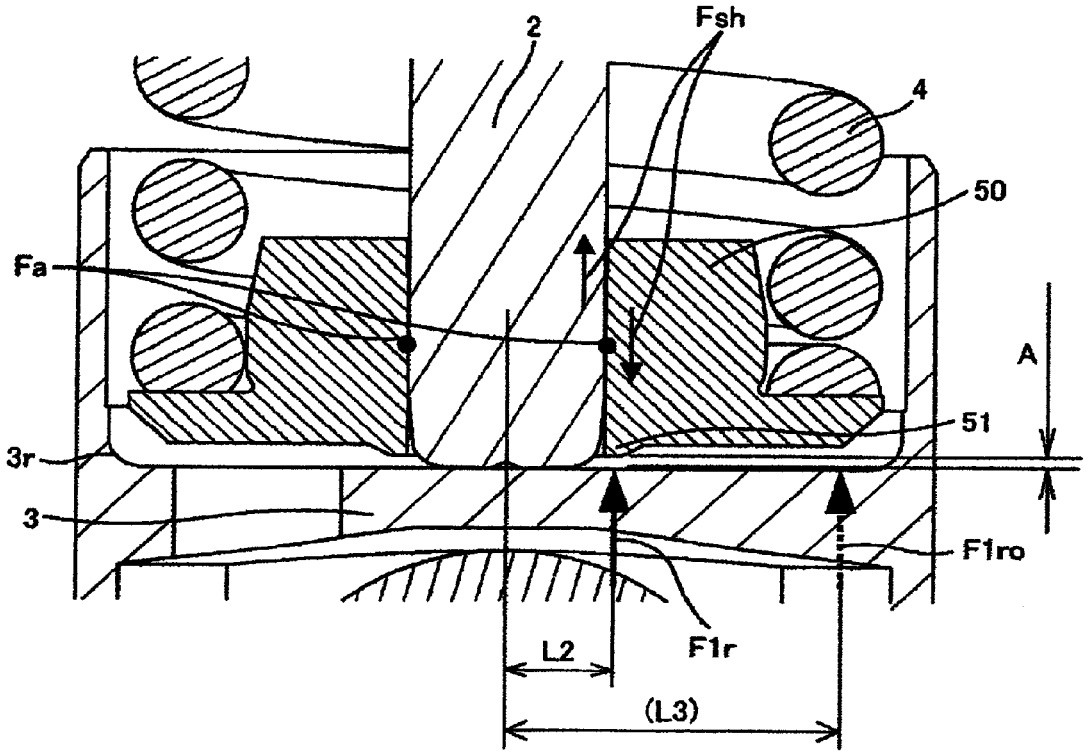
FIG. 10 is a partly enlarged cross sectional view of an embodiment 2.

An embodiment 2 is shown in FIG. 10. In the second embodiment, the plunger 2 is protruded from the retainer 50 at a distance A, for example, about 0 to 1 mm, as shown in FIG. 10. When the pump constructed as mentioned above is actuated normally, the axial force F1 is received only by the plunger 2, the bending moment becomes smaller. At this time, the projection 51 does not make sense especially, however, achieves a fail safe function in the following case.

The first case is a case that the fixing force Fa of the plunger 2 and the retainer 50 is lowered. In the case that the retainer 50 undesirably moves to the tappet side from the initial position with respect to the plunger 2 by the force Fsh which intends to drag away the retainer 50 from the plunger 2 mentioned above, the projection 51 of the retainer avoids a full surface contact of the retainer so as to prevent an excessive moment from acting on the plunger 2. In other words, the bending moment M=F1*r*×L2 is sufficient in the case that the projection 51 is provided, however, the bending moment comes to M=F1*ro*×L3 in the case that the projection is not provided, and an excessive moment is applied.

The second case is a case that the contact portion of the tappet 3 and the plunger 2 is worn away with age. In the case that the dimension of the protruding amount A from the plunger 2 of the retainer 50 is undesirably worn away, the excessive bending moment is applied on the basis of the full surface contact with the tappet 3 in the case that the projection 51 is not provided in the same manner as the first case, however, it is possible to prevent the full surface contact by providing the projection 51 and it is possible to make the bending moment small.

Embodiment 3

Figure 11:
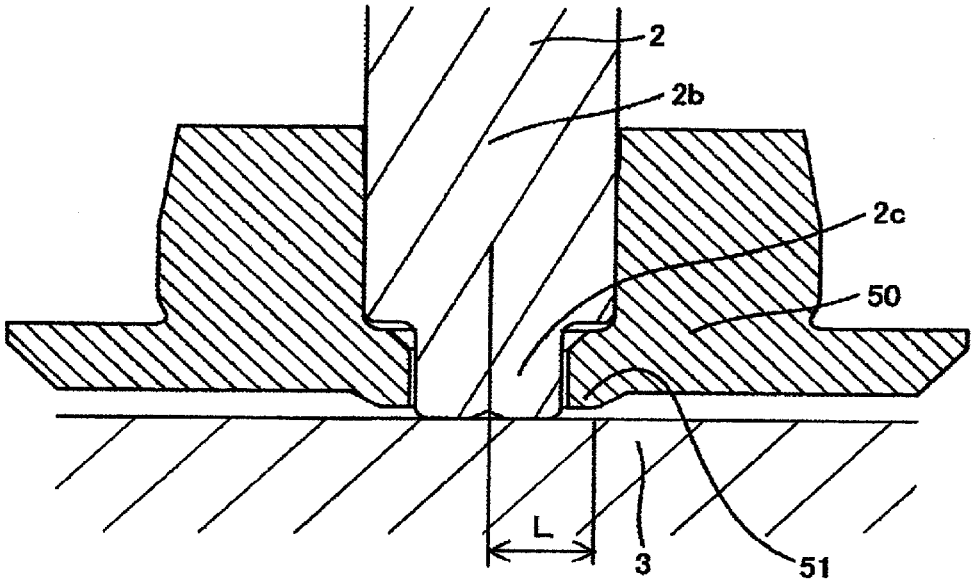
FIG. 11 is a partly enlarged cross sectional view of an embodiment 3.

FIG. 11 is a shape in which a smaller diameter portion 2*c* is provided in a leading end of the smaller diameter portion 2*b* of the plunger 2 in order to make the bending moment mentioned above small. In accordance with the present shape, the bending moment can be made smaller by making a distance L from the center of the plunger 2 to the contact point between the projection 51 of the retainer 50 and the tappet 3 smaller than the embodiment 1.

Embodiment 4

Figure 12:
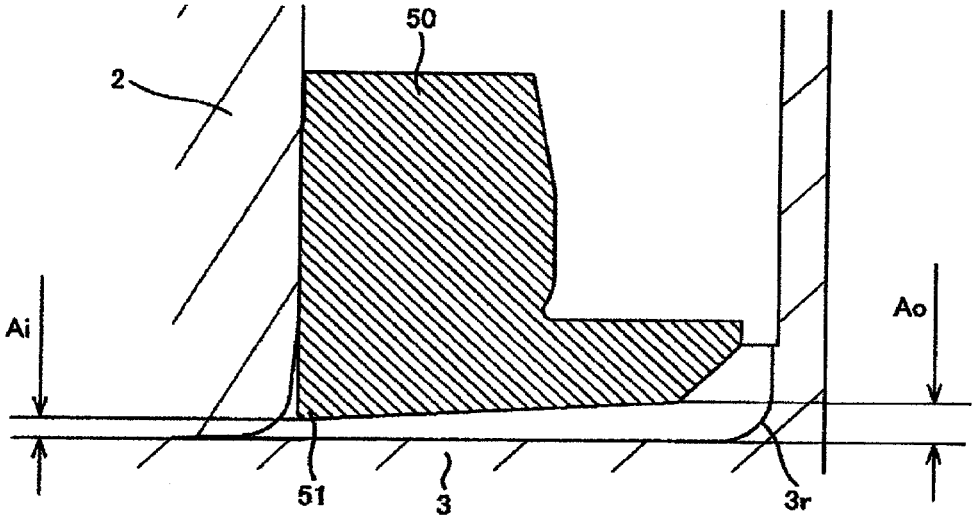
FIG. 12 is a partly enlarged cross sectional view of an embodiment 4.

FIG. 12 shows a case that the projection 51 is formed as a maximum protruding portion which is formed in a center of a conical leading end portion opposed to the tappet 3 in the retainer 50. In other words, it is an example which is constructed by a shape having such a slope that a gap with respect to the surface of the tappet becomes larger in accordance with going closer to an outer side in a radial direction of the retainer 50. The same function as the projection 51 in the previous embodiment can be achieved by setting such that the clearance between the retainer 50 and the tappet 3 becomes smaller in the clearance of the center portion in comparison with the outer peripheral portion of the retainer in the surface opposed to the tapper 3 in the retainer 50, that is, setting such as to satisfy Ai<Ao.

Embodiment 5

Figure 13:
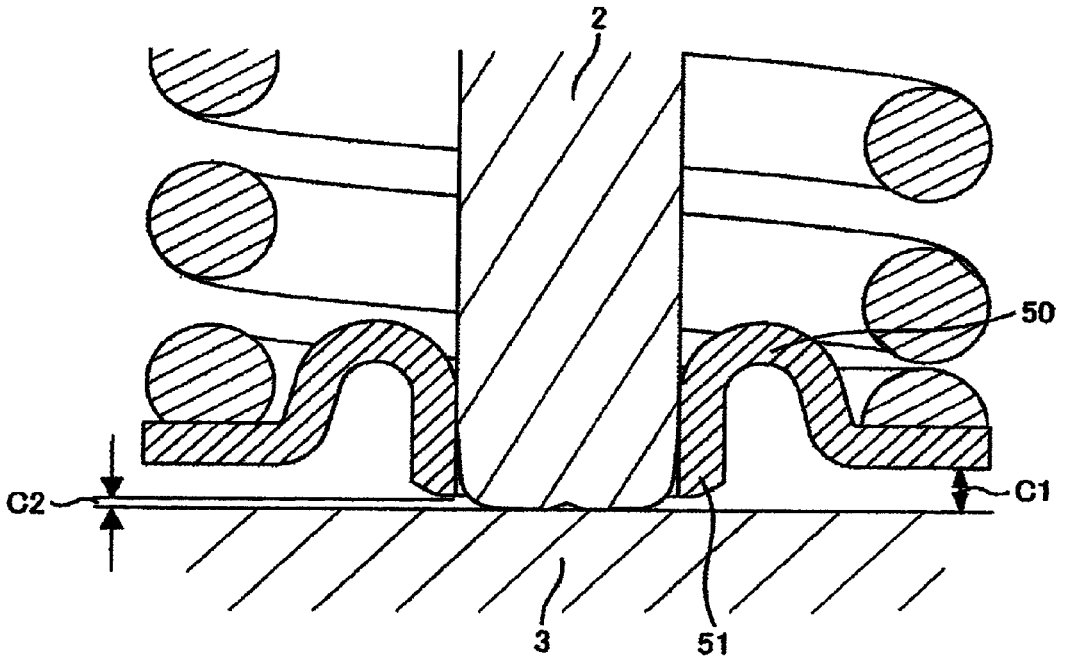
FIG. 13 is a partly enlarged cross sectional view of an embodiment 5.

FIG. 13 is an example in which the retainer 50 is press molded from the sheet material. In this case, it is structured such that a clearance C2 with respect to the tappet 3 in the portion of the projection 51 which is formed annularly in the center portion of the retainer is smaller than the clearance C2 in the outer peripheral portion.

A common concept of the embodiments is to achieve the object mentioned above by devising the shape of the retainer without lowering the strength of the plunger, without complicating the shape of the retainer, and without increasing the assembling man power at a time of fixing the plunger to the retainer. In the retainer, the object described at the outset can be achieved by providing the projection in the surface in the opposite side to the surface coming into contact with the spring and receiving the spring force, that is, the center portion of the surface opposed to the tappet, or setting the clearance between the contact surface with the plunger in the tappet and the surface facing to the tappet in the retainer larger in the clearance of the outer peripheral portion of the retainer in comparison with the center portion of the retainer.

In accordance with the embodiments 1 to 5 mentioned above, it is possible to provide the high-pressure fuel pump in which the fixing method of the plunger 2 and the retainer 50 is easy and the reliability is high.

In this case, the following items can be thought as the environmental factor described in the disclosure of the invention.

1) repeated load applied from the spring 2) vibration of the engine which is transmitted through the pump housing and the plunger 3) micro relative moment which is generated in the pressure insertion surface on the basis of the difference of thermal expansion of the material of the plunger retainer applied by the temperature cycle caused by the used environment 4) micro relative movement which the difference of thermal expansion caused by the temperature difference generated between the parts of the plunger and the retainer due to the heat receive from the engine side and the heat radiation to the fuel side in the inner portion of the pump causes in the pressure insertion surface.

The present invention can be applied to a water pump, a hydraulic pump, a pump for a diesel vehicle and the like, in addition to the high-pressure fuel pump of the cylinder injection type internal combustion engine. Further, it is possible to apply to a mechanism which requires a receiving member (a retainer) for actuating the shaft parts by the spring such as a valve gear system of the engine without being limited to the pump.

It should be further understood by those skilled in the art that although the foregoing description has been made on embodiments of the invention, the invention is not limited thereto and various changes and modifications may be made without departing from the spirit of the invention and the scope of the appended claims.

DESCRIPTION OF REFERENCE NUMERALS

1 pump body
2 plunger
3 tappet
4 spring
5 cam
6 cylinder
7 cylinder holder
8 discharge valve mechanism
9 damper mechanism
10 low pressure passage
11 pressurizing chamber
30 electromagnetic drive type intake valve
50 retainer

The invention claimed is:

1. A high-pressure fuel pump comprising:

a pump body in which a pressurizing chamber is formed;

a plunger that is configured to change a volume of the pressurizing chamber;

a retainer that is fixed to an opposite side of the plunger;

a spring that is configured to energize the plunger in a direction opposite to a direction of the pressurizing chamber; and a tappet covering the retainer from a side of an end portion of the retainer and the plunger, wherein the retainer is provided with a projection portion protruding to a side of the tappet, and the projection portion is separated from the tappet by a predetermined distance along an axial direction of the plunger.

2. The high-pressure fuel pump as claimed in claim 1, wherein the predetermined distance between the projection portion of the retainer and the tappet is smaller than other clearances formed between the retainer and the tappet along the axial direction of the plunger, the other clearances are formed outside the projection portion.

3. The high-pressure fuel pump as claimed in claim 1, wherein the projection portion of the retainer is inclined toward a bottom part of the tappet from an outer circumference side of the tappet to an inner circumference side.

4. The high-pressure fuel pump as claimed in claim 1, wherein the projection portion of the retainer is provided with a planar part and an inclined part formed outside of the planar part.

5. The high-pressure fuel pump as claimed in claim 1, wherein the projection portion of the retainer has a spherical surface in a leading end portion thereof.

6. The high-pressure fuel pump as claimed in claim 1, wherein a surface hardness of the projection portion of the retainer is smaller than a surface hardness of the plunger.

7. The high-pressure fuel pump as claimed in claim 1, wherein the retainer and the projection portion are integrally formed by press molding from a sheet member.

8. The high-pressure fuel pump as claimed in claim 1, wherein a chamfer is applied to an outer peripheral portion of the retainer which is opposed to an inner peripheral surface of the tappet.

9. The high-pressure fuel pump as claimed in claim 1, wherein an end surface of the plunger protrudes out of a leading end portion of the projection portion to a bottom side of the tappet.

10. The high-pressure fuel pump as claimed in claim 1, wherein a through hole is formed within the retainer portion, and the plunger is press-fitted with the retainer portion.

11. The high-pressure fuel pump as claimed in claim 1, wherein the projection portion is closer to the plunger than to the spring.

12. The high-pressure fuel pump as claimed in claim 11, wherein an end of the retainer portion, on which the projection is defined, is flat except for the projection.

13. A high-pressure fuel pump comprising:

a pump body in which a pressurizing chamber is formed;

a plunger that is configured to change a volume of the pressurizing chamber;

a retainer that is fixed to an opposite side of the plunger;

a spring that is configured to energize the plunger in a direction opposite to a direction of the pressurizing chamber; and a tappet covering the retainer from a side of an end portion of the retainer and the plunger, wherein the retainer is provided with a projection portion protruding to a side of the tappet, and the projection that extends away from the retainer along a longitudinal direction of the high-pressure fuel pump, wherein a fixing force fixes the retainer relative to the plunger in such a way that when the plunger contacts the tappet, the projection is separated from the tappet by a predetermined distance along an axial direction of the plunger.

14. A high-pressure fuel pump comprising:

a pump body in which a pressurizing chamber is formed;

a plunger that is configured to change a volume of the pressurizing chamber;

a retainer that is fixed to an opposite side of the plunger;

a spring that is configured to energize the plunger in a direction opposite to a direction of the pressurizing chamber; and a tappet covering the retainer from a side of an end portion of the retainer and the plunger, wherein the retainer is provided with a projection portion protruding to a side of the tappet, the projection that extends away from the retainer along a longitudinal direction of the high-pressure fuel pump toward the tappet, the plunger includes a concave portion in the middle thereof that defines a void when the plunger contacts the tappet, a fixing force fixes the retainer relative to the plunger in such a way that when the plunger contacts the tappet, the projection is separated from the tappet by a predetermined distance along an axial direction of the plunger; and the retainer includes an inclined section that extends from a first surface of the retainer that is immediately to the tappet to a second surface of the retainer that is immediately adjacent to the spring, so that the second surface extends radially away from the concave portion farther than the first surface by an amount that is at least three times larger than the predetermined distance.

* * * * *